US005865636A

United States Patent [19]

Myer et al.

[11] Patent Number: 5,865,636

[45] Date of Patent: Feb. 2, 1999

[54] SEAL FOR USE WITH AN ELECTRICAL CONNECTOR COMPRISING INSULATION DISPLACEMENT TYPE CONTACTS

[75] Inventors: John Mark Myer, Millersville; John Raymond Shuey, Mechanicsburg, both of Pa.

[73] Assignee: The Whitaker Corporation, Wilmington, Del.

[21] Appl. No.: 949,441

[22] Filed: Oct. 16, 1997

Related U.S. Application Data

[63] Continuation of Ser. No. 622,637, Mar. 27, 1996, abandoned.

[51] Int. Cl.[6] ..... H01R 13/52

[52] U.S. Cl. ..... 439/275; 439/587

[58] Field of Search ..... 439/275, 274, 439/271, 587, 589, 281, 599, 695, 686, 696, 586

[56] References Cited

U.S. PATENT DOCUMENTS

| | | | |
|---|---|---|---|
| 1,422,910 | 7/1922 | Young et al. . | |
| 2,956,106 | 10/1960 | Hasselhorn et al. . | |
| 3,003,084 | 10/1961 | Wilkinson . | |
| 4,243,288 | 1/1981 | Lucius et al. | 439/599 |
| 4,488,008 | 12/1984 | Dellinger et al. | 179/81 R |
| 4,575,169 | 3/1986 | Duplatre et al. | 339/44 M |
| 4,624,514 | 11/1986 | Smith | 379/412 |
| 4,658,422 | 4/1987 | Sparks | 379/442 |
| 4,690,478 | 9/1987 | Rahrig et al. | 439/271 |
| 4,988,834 | 1/1991 | Birch | 174/93 |
| 5,100,355 | 3/1992 | Yamamoto | 439/271 |
| 5,101,079 | 3/1992 | Rodriques et al. | 174/65 R |
| 5,145,388 | 9/1992 | Brownlie et al. | 439/142 |
| 5,145,410 | 9/1992 | Maejima et al. | 439/587 |
| 5,197,898 | 3/1993 | Nagamine | 439/271 |
| 5,323,454 | 6/1994 | Shay et al. | 379/327 |
| 5,580,263 | 12/1996 | Kourimsky | 439/248 |
| 5,580,264 | 12/1996 | Aoyama et al. | 439/587 |
| 5,766,039 | 6/1998 | Abe | 439/587 |

*Primary Examiner*—Paula Bradley
*Assistant Examiner*—Tho D. Ta
*Attorney, Agent, or Firm*—Bradley N. Ditty

[57] ABSTRACT

An electrical connector assembly (10) comprising a housing (20) with a latch arm (30), a CPA (40) received in the latch arm (30), an inner housing (50) received within the housing (20), a wire seal (60) disposed on the inner housing (50) and retained by a seal retainer (70) and posts (51), a wire cover (80), and a header housing (90). Wire seal (60) includes wire receiving slits (67) therein for advantageously receiving wires (17) during an insulation displacement type wire termination operation, and wire seal (60) includes frusto-conical sections for insuring that wires are sealed against the retainer (70), and inner housing (50).

8 Claims, 6 Drawing Sheets

Fig. 4
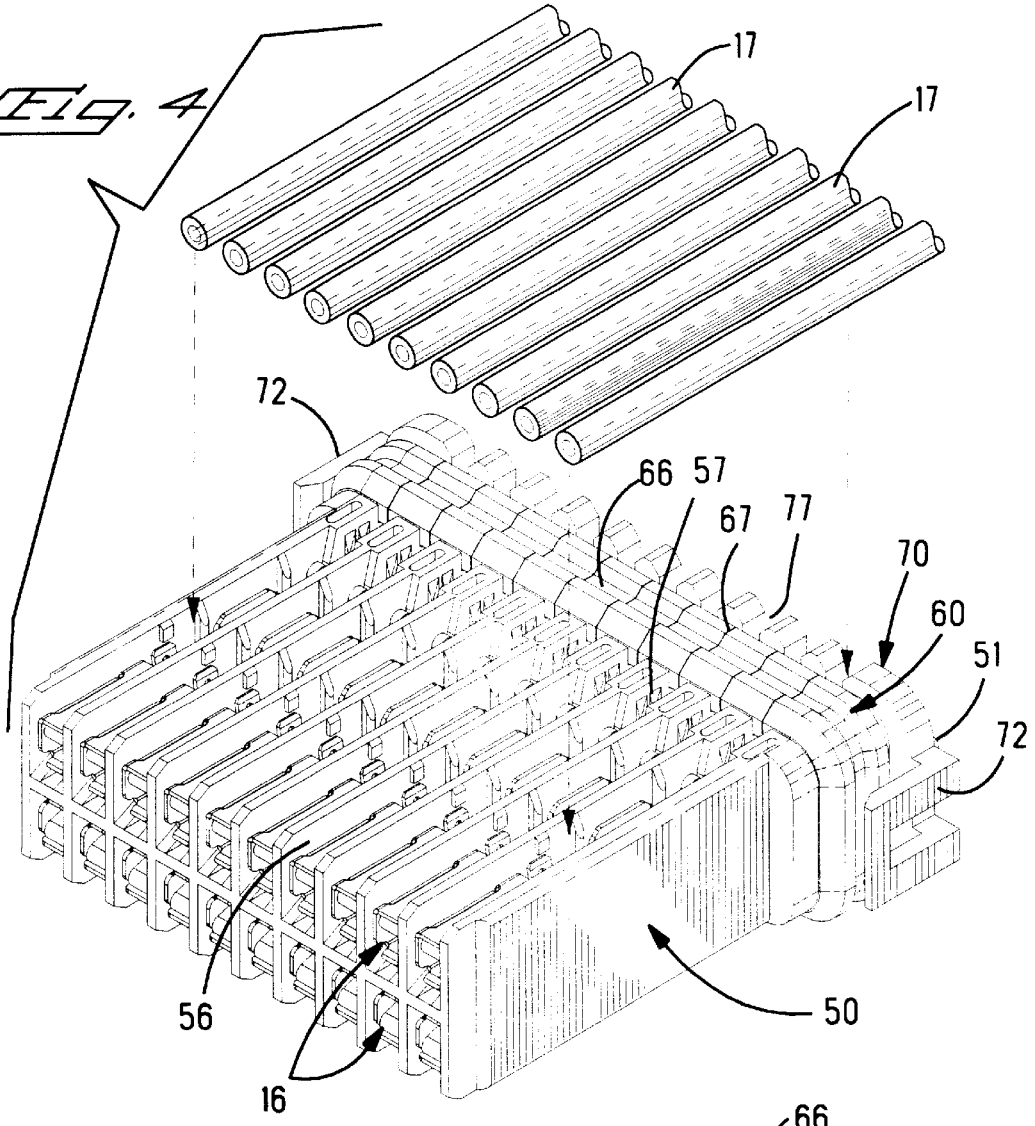
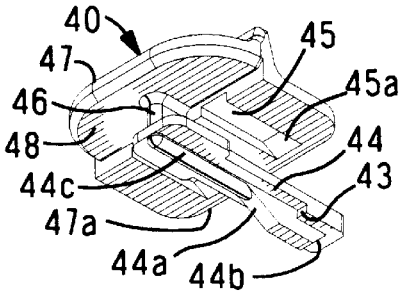
Fig. 2b
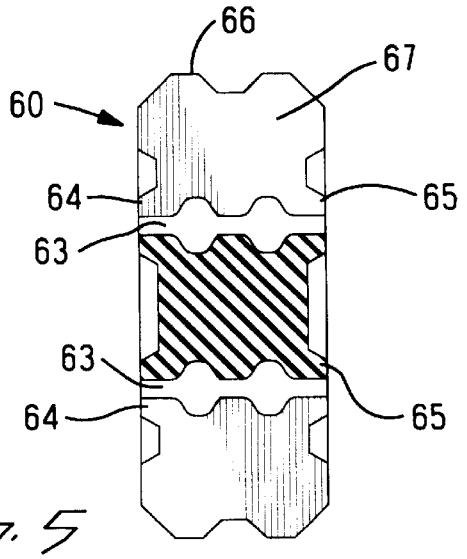
Fig. 5

SEAL FOR USE WITH AN ELECTRICAL CONNECTOR COMPRISING INSULATION DISPLACEMENT TYPE CONTACTS

This application is a Continuation of Application Ser. No. 08/622,637 filed Mar. 27, 1996, now abandoned.

The present invention relates to a seal for use with an electrical connector assembly comprising insulation displacement type contacts disposed in an inner housing thereof. The seal advantageously includes slits formed therein for accommodating wires terminated to the respective insulation displacement type contacts of the connector assembly.

BACKGROUND OF THE INVENTION

Sealed electrical connectors are used in the automotive industry to protect electrical connections from moisture or other contaminants. Insulation displacement type contacts are advantageously used in the automotive industry for inexpensive, reliable mass termination of wires in electrical connectors. Conventional automotive sealed electrical connectors are constrained to use wire crimp technology, and require the assembly step of inserting the crimped terminal or the housing through the seal, thus risking damage to the seal. What is needed is a seal which can withstand the temperature and vibration inherent in an automotive environment, but is advantageously adapted for use with insulation displacement type contacts without diminishing its sealing performance.

A known sealed connector is disclosed in U.S. Pat. No. 5,100,335. This crimp technology connector system requires a seal having slits formed therein, but the slits are not used to enhance assembly of the electrical contacts within the assembly. Rather, the slits are used to interlock the seal with projections on the connector housing wall.

The present invention has solved the foregoing problem by providing a seal for use with an electrical connector having insulation displacement type contacts therein, but which seal is reliably operative to seal against moisture and other contaminants.

SUMMARY OF THE INVENTION

In view of the foregoing, the present invention provides a seal for use with an electrical connector housing having electrical contacts therein, the seal comprises apertures formed in the seal for receiving wires aligned to exit the electrical connector housing, and the seal advantageously comprises respective slits in communication with the apertures for receiving the conductors therethrough during a wire termination process of the electrical contacts.

Additionally, the seal comprises respective protuberances adjacent to the apertures for cooperating with corresponding structure on the connector housing, and the seal comprises post receiving apertures therethrough for receiving respective posts of the connector housing. Moreover, the seal includes undulated surfaces, and the slits divide the undulated surfaces into segments of the seal, but the sealing performance of the seal is maintained due to the housing structure which cooperates with the seal. In the preferred embodiment; the seal includes at least one row of contact receiving apertures, and respective slits extend away from the apertures in generally opposed directions.

BRIEF DESCRIPTION OF THE DRAWINGS

FIG. 2*b* is an isometric view of the CPA of the connector assembly.

FIG. 4 shows an isometric view of an inner housing and seal subassembly of the present invention with wires shown prior to termination with insulation displacement contacts in the inner housing.

FIG. 5 shows a cross section of the seal of FIG. 1.

DETAILED DESCRIPTION OF THE INVENTION

Figure 1:
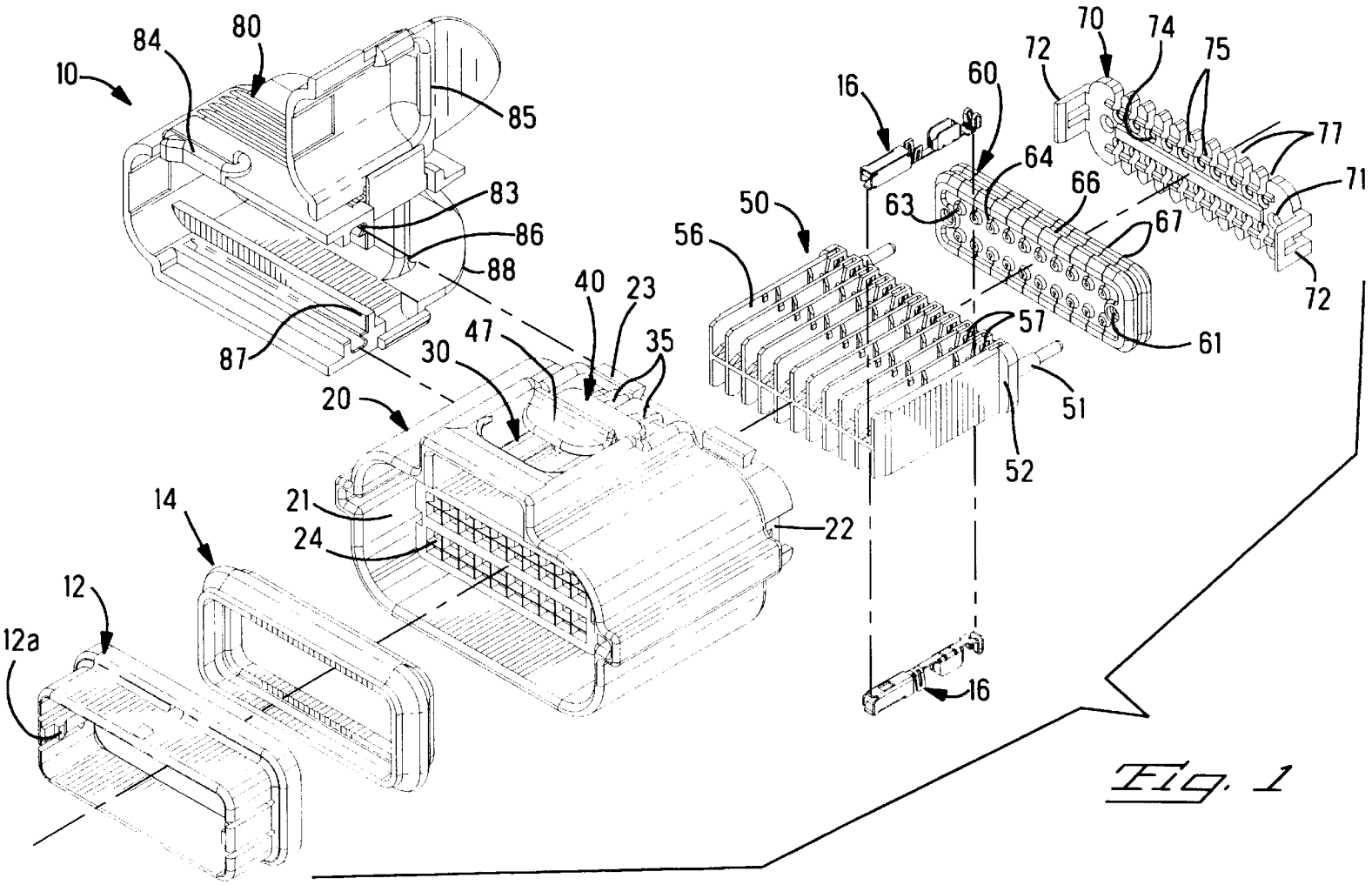
FIG. 1 is an exploded isometric view of an electrical connector assembly according to the present invention.
Figure 6:
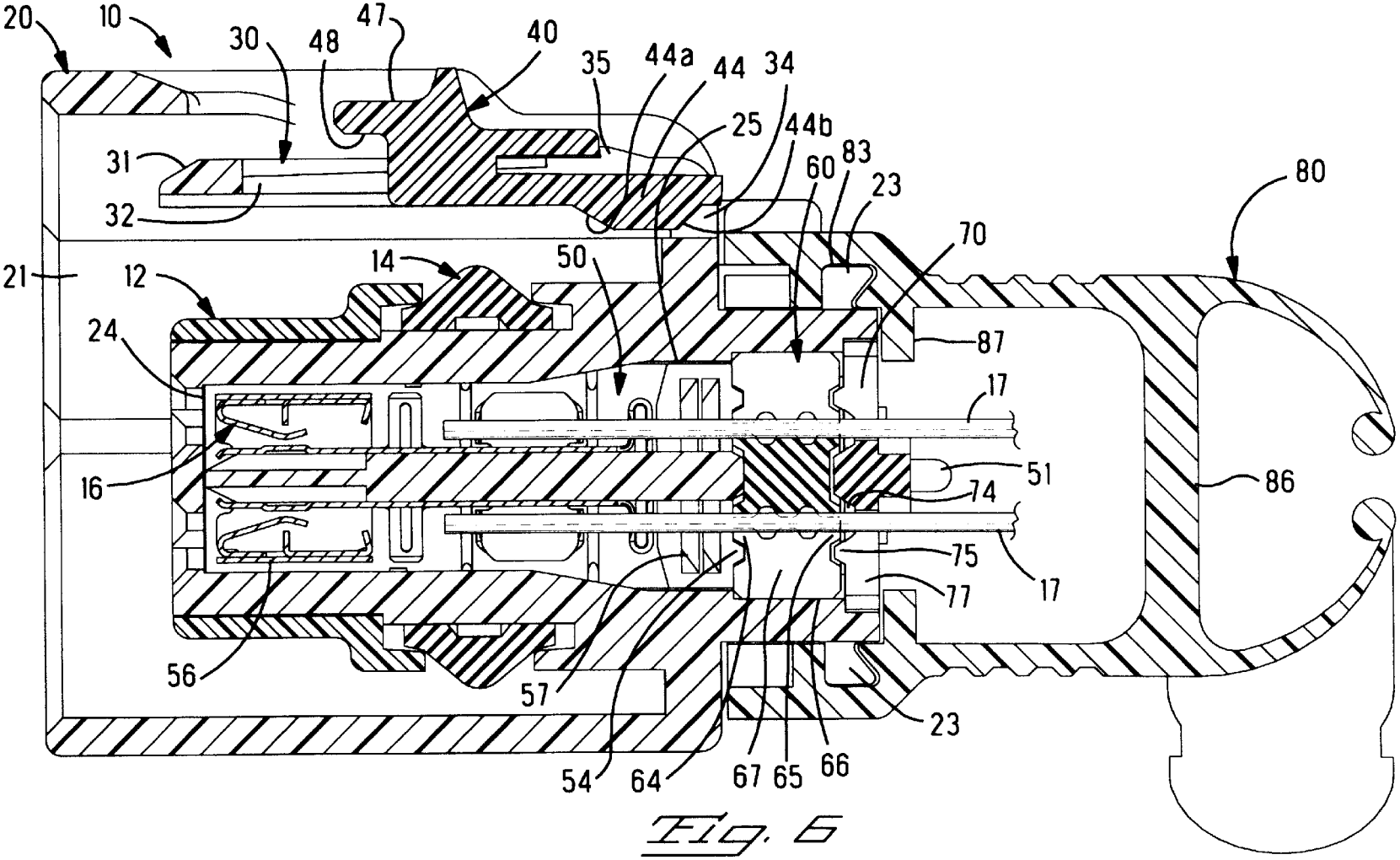
FIG. 6 shows a cross sectional view of the assembly of FIG. 3 taken along line 6—6.

Referring to FIG. 1 a connector assembly 10 according to the present invention will be described. Connector assembly 10 comprises a housing 20 with a latch arm 30 formed thereon, a connector position assurance device (CPA) 40, an inner housing 50, a wire seal 60, a seal retainer 70, a wire cover 80, and a header housing 90 (shown in FIGS. 7–10). Housing 20 includes a cavity 21 for receiving an interface seal 14 which is retained in cavity 21 by seal retaining shroud 12 which includes latching structure 12*a* for latching the seal retaining shroud 12 to the housing 20. Housing 20 also includes contact receiving apertures 24 for receiving contacts 16 after they are assembled to housing 50. Additionally, housing 20 includes latching recesses 22 for receiving latches 72 of seal retainer 70, and includes lugs 23 for slidable connection with recesses 83 of wire cover 80. As shown in FIG. 6, housing 20 includes an inner housing receiving cavity 25 for receiving inner housing 50 therein.

Referring to FIGS. 1–3 and 6, the latch arm 30 of housing 20 includes a rail 31, grooves 32 for slidably receiving CPA 40, stop projections 33 for engagement with portions of connection position assurance device 40, a flexible connecting section 34 which flexibly connects latch arm 30 to housing 20, and prelatch bumps 35 for maintaining connection position assurance device 40 in a prelatch position relative to housing 20.

Again referring to FIGS. 1–3 and 6, CPA 40 will be more fully described CPA 40 includes: flanges 42 for slidable disposition in grooves 32 of latch arm 30; stop abutments 43 for cooperating with stop projections 33 of latch arm 30 thereby controlling the motion of CPA 40; a deflectable beam 44 including an advance taper 44*a*, a retraction taper 44*b*, and a rib 44*c*; prelatch grooves 45 having tapers 45*a* for maintaining the CPA in a prelatch position relative to housing 20; a flexible support section 46; an operating section 47 which is connected to flanges 42 through support section 46 and which includes a back edge 47*a*; and a bearing surface 48 for engaging a portion of header housing 90.

Now referring to FIGS. 1, 4, and 6 inner housing 50 will be described. Inner housing 50 includes: posts 51 which are configured to extend through corresponding apertures in seal 60 and seal retainer 70; latching shoulders 52 for cooperating with latches 72 of seal retainer 70 (as will be further described below); ribs 54 for cooperating with wire seal 60 (see FIG. 6); contact receiving cavities 56 for receiving contacts 16 therein; and wire receiving sections 57 for retaining wires 17 in the housing.

Referring to FIGS. 1 and 4–6, wire seal 60 includes: post receiving apertures 61 for receiving posts 51 of inner housing 50; wire receiving apertures 63 having undulated surfaces for receiving wires 17 (see FIG. 4); frusto-conical sections 64 and 65 for cooperating with corresponding structure 54 and 75 of inner housing 50 and seal retainer 70, respectively; outer undulated rib surface 66 for providing sealing between the inner housing 50 and housing 20; and wire receiving slits 67 associated with wire receiving apertures 63 for receiving wires 17 therein, as will be further described below.

Referring to FIGS. 1, 4 and 6, seal retainer 70 includes: post receiving holes 71 for receiving posts 51 therein; latches 72 for latching to latch recesses 22 of housing 20; recesses 74 for receiving frusto-conical sections 65 of wire seal 60; ribs 75 for cooperating with frusto-conical sections 65 of wire seal 60; and wire slots 77 for receiving wires 17 after termination with contacts 16.

Referring to FIGS. 1–3, and 6, wire cover 80 includes: lug receiving grooves 83; a latch 84 for latching the wire cover 80 to housing 20; a hinged door 85 for closing the cover after wires 17 have been laced around inner wall 86; and abutment flanges 87 for engaging seal retainer 70 when the wire cover is mounted onto housing 20.

FIGS. 7–10 show the header housing 90 according to the present invention. Header housing 90 includes: a latch projection 91 for latching connection to rail 31 of latch arm 30; a deflection member 94 with an advance taper 94*a* and a retraction taper 94*b*; a slot 96 for receiving support section 46 of CPA 40; and a recess 97 having bearing plates 98 therein for engagement with bearing plate 48 of CPA 40.

Referring now to FIGS. 4–6, the sealing aspects of the present invention will be described. First, the seal 60 is mounted to inner housing 50 such that posts 51 will be inserted into respective post receiving apertures 61 of seal 60, and the retainer 70 will then be pressed on the seal so that posts 51 will protrude through respective apertures 71 of retainer 70. At this point, posts 51 are heat-staked and they will firmly retain seal retainer 70 against seal 60 so that seal 60 is sealingly disposed between inner housing 50 and seal retainer 70. Posts 51 can comprise cross sections other than circular. Any elongated member suitable for heatstaking and use with seal 60 can form posts 51.

Next, the contacts 16 are assembled to inner housing 50, and inner housing 50 is assembled to connector housing 20 by insertion into cavity 25 thereof so that insulation displacement sections of contacts 16 are exposed for receipt of wires 17. Wires 17 are insulation displacement terminated with contacts 16. As the termination step occurs, insulated portions of wires 17 will displace portions of seal 60 as the wires are pressed through respective slits 67 of seal 60. Thus wires 17 will be terminated into respective contacts 16, the wires will pass through respective wire apertures 63 of seal 60, and will be received in respective wire slots 77 of retainer 70. It is important to note that any slit 67 can be offset at an angle relative to a respective aperture 63, and/or the surfaces of any slit 67 can be profiled, e.g. convoluted, undulated, a wave form, saw-tooth, dimpled, etc. without departing from the scope of the appended claims.

As the subassembly defined by inner housing 50, seal 60, and retainer 70 is inserted into housing 20 at cavity 25, latches 72 will latchably engage latching recesses 22 of housing 20 and inner housing 50 is thereby firmly connected to housing 20. At this point, the wires 17 extend from retainer 70, and wire cover 80 is installed on housing 20 so that lugs 23 will be slidably disposed in recesses 83 of cover 80. Wires 17 will be dressed around inner wall 86 of wire cover 80 and laced through flexible walls 88 of the wire cover thereby providing additional strain relief to the wires. FIG. 6 shows the assembly of wire cover 80 to housing 20 with retainer 70 pressing against seal 60, which seal is trapped between inner housing 50 and retainer 70. Ribbed outer surface 66 of seal 60, as shown in FIG. 5, is shown flattened against the cavity wall of cavity 25 in FIG. 6, this causes the seal material to flow so that a primary constriction of undulated surfaces in apertures 63 occurs resulting in sealing pressure against wires 17. Moreover, the seal can be treated with a gel material to enhance its sealing performance.

In an advantage of the invention, wires 17 will be sealingly disposed in the assembly 10 such that fluid pressures acting on the seal 60 will force frusto-conical sections 65 into frusto-conical recesses 74 of retainer 70, and sections 65 will thereby be further constricted against the wires 17. On the opposed side of seal 60, the frusto-conical sections 64, when pressed into engagement with ribs 54 of inner housing 50, will likewise be constricted against wire 17 thereby providing excellent sealing of the wires in the connector assembly 10.

Figure 2A:
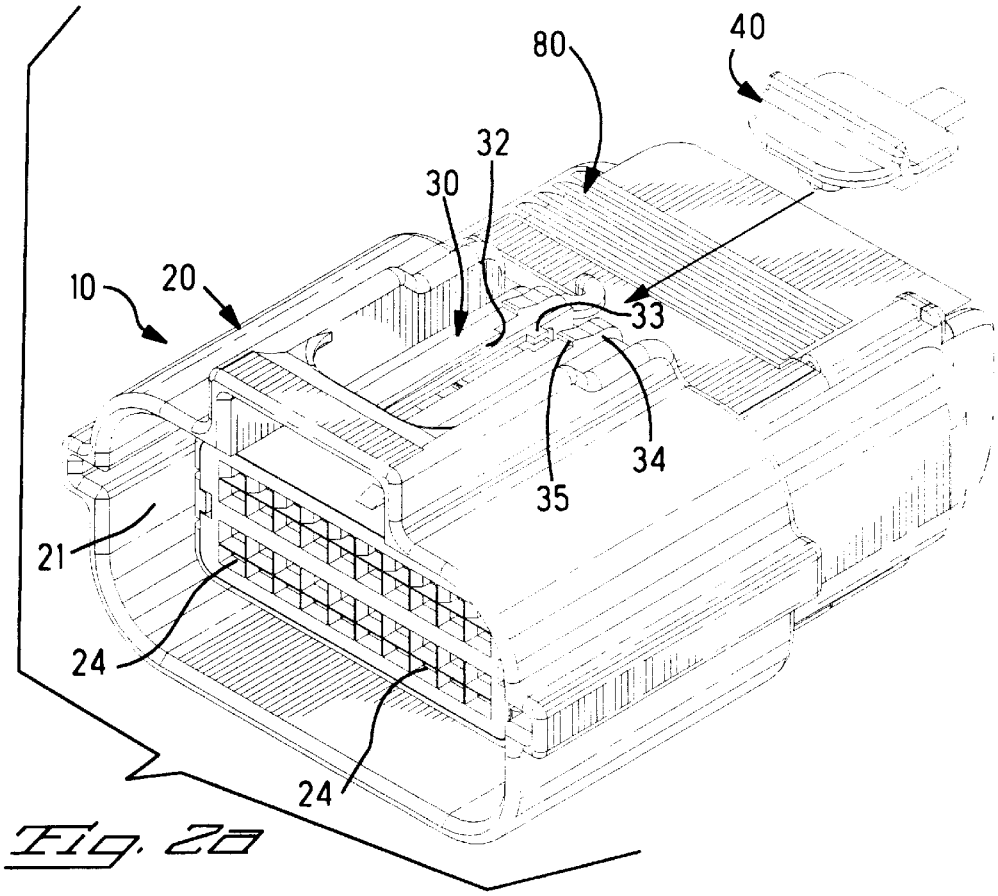
FIG. 2*a* is an assembly view of the connector assembly of FIG. 1 with an inset drawing of the connector position assurance device of the present invention.
Figure 3:
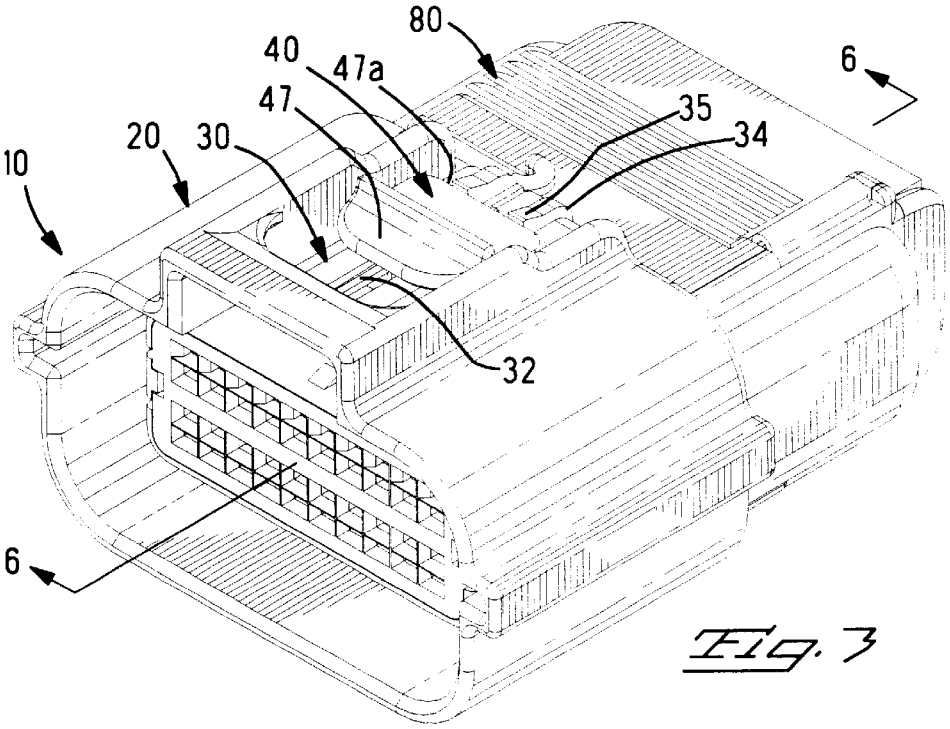
FIG. 3 is an isometric view of the assembly of FIG. 2 with the connector position assurance device installed on the connector assembly.

Now referring to FIGS. 2*a*, and 2*b* and 6, the assembly of CPA 40 onto housing 20 will be described. FIG. 2 shows the CPA 40 exploded away from housing 20; CPA 40 is aligned with latch 30 and is to be pressed into positive engagement therewith in a prelatch position. The prelatch position of CPA 40 requires prelatch bumps 35 of latch 30 to be slid into prelatch grooves 45 of CPA 40. Tapers 45*a* thereof will slidably engage the tapers of prelatch bumps 35 and will thereby resiliently deflect the operating section 47 of CPA 40 upwardly so that the CPA can be advanced toward the mating face of housing 20. When the CPA 40 has been advanced toward the mating face, operating section 47 will resile downwardly in a snapping action so that back edge 47*a* of operating section 47 will be disposed against prelatch bumps 35.

Flange 42 of CPA 40 is slidably disposed in grooves 32 of latch 30 when the back edge 47*a* is engaged with prelatch bumps 35; however, stop abutments 43 will be engaged with stop projections 33 of latch 30 when CPA 40 is in the prelatch position. Thus, CPA 40 is positively trapped on latch 30 between prelatch bumps 35 and stop projections 33. In this prelatch position, the CPA 40 cannot be further advanced toward the mating face of housing 20.

Figure 7:
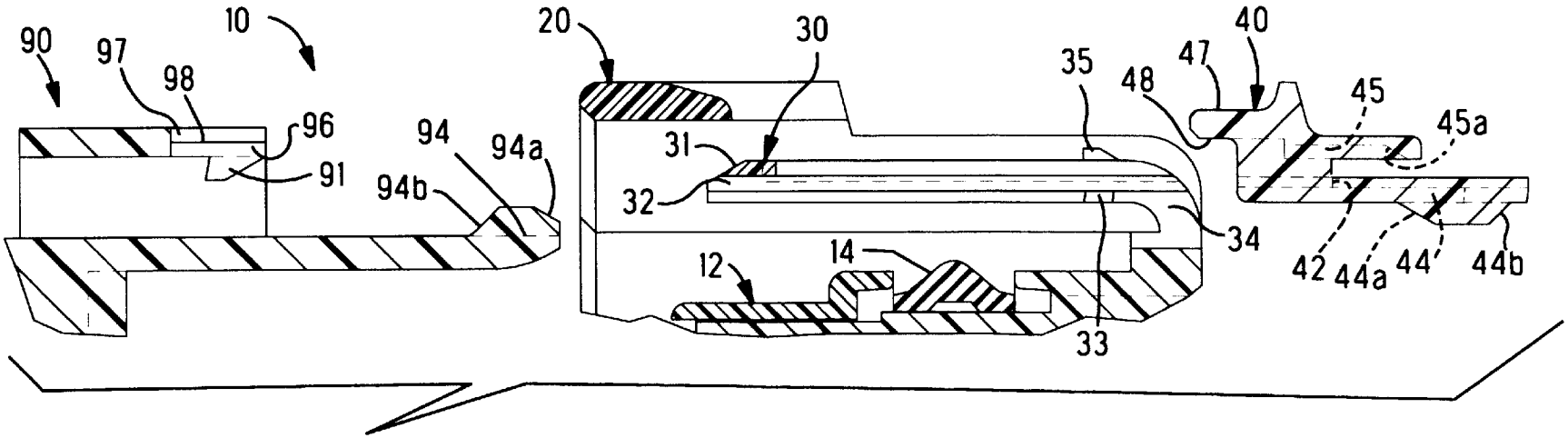
FIG. 7 shows a cross sectional, pre-assembly view of the connector assembly with a header.
Figure 8:
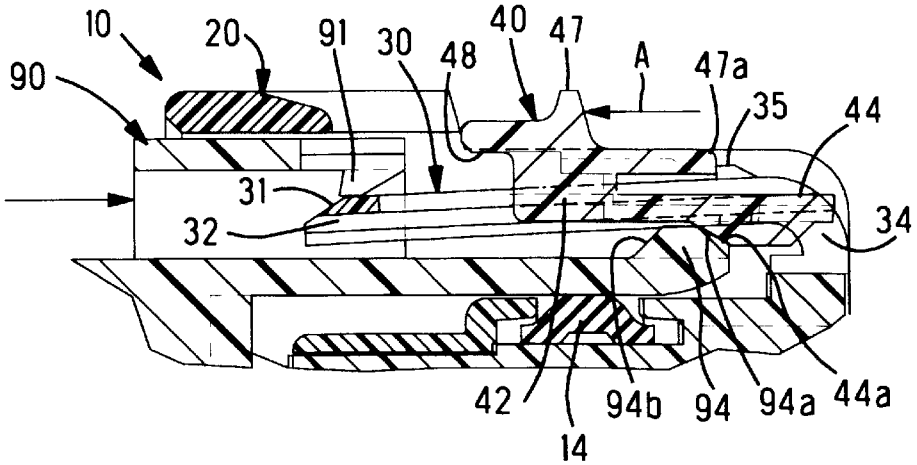
FIG. 8 shows the connector housing, header, and connector position assurance device in a prelatched position.

Now referring to FIGS. 7–10, operation and interaction of the housing 20, CPA 40 in the aforementioned prelatch position, and header 90 will be described. As shown in FIG. 7, housing 90 is aligned for engagement with housing 20 so that deflection member 94 will be inserted below latch 30; and latch projection 91 will be disposed above latch 30 and will engage rail 31 and deflect the latch 30 as shown in FIG. 8. At this point, advance taper 94*a* of deflection member 94 will engage advance taper 44*a* of beam 44 thereby deflecting beam 44. When beam 44 is deflected as shown in FIG. 8, stop abutments 43 will begin to be lifted away from engagement with stop projections 33 of latch 30.

Figure 9:
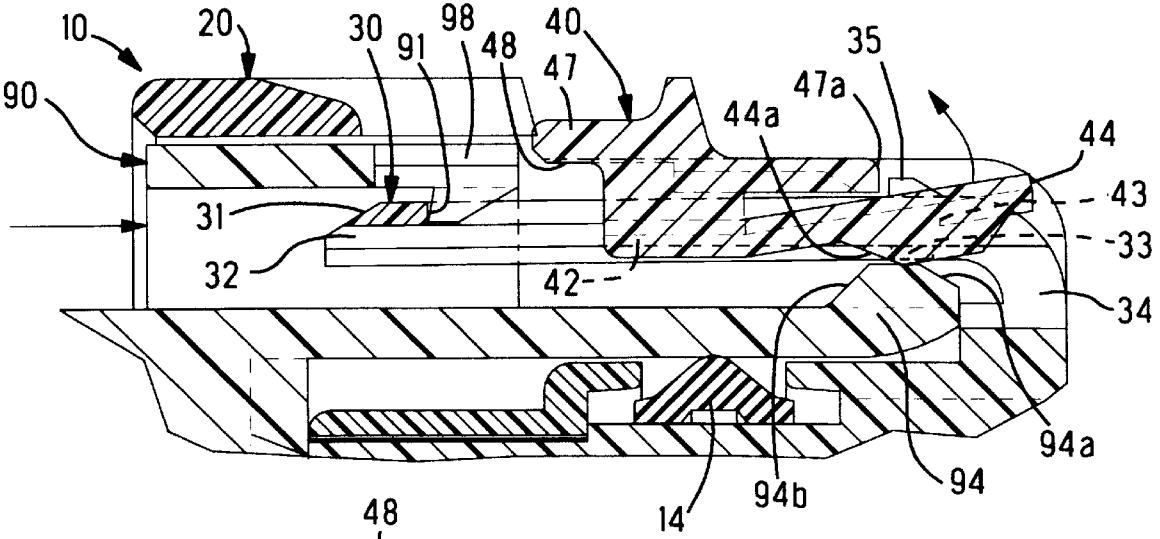
FIG. 9 shows the connector position assurance device in engagement with a portion of the header but prior to full advancement of the connector position assurance device relative to the assembly.

FIG. 9 shows that latch 30 has resiled upwardly so that rail 31 is in positive latching engagement with latch projection 91 of header 90. Beam 44 of CPA 40 has been fully deflected upwardly, and CPA 40 is free to be advanced toward the mating face of housing 20 in the direction of arrow A of FIG. 8.

Figure 10:
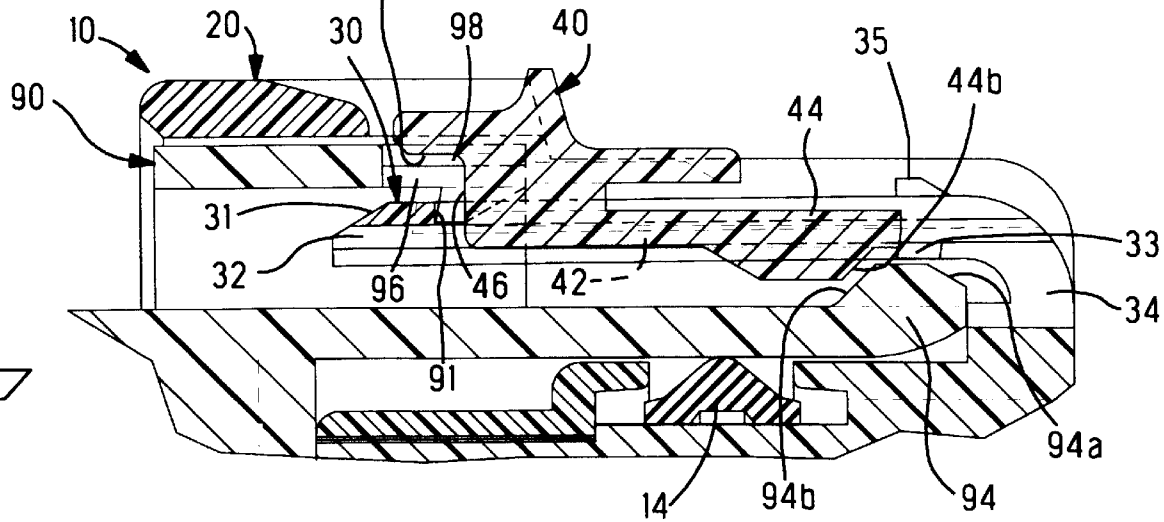
FIG. 10 shows the of the present invention in its final position on the assembly.

FIG. 10 shows the fully advanced state of CPA 40 wherein: support section 46 of CPA 40 has been pushed into slot 96 of header 90; bearing surface 48 of CPA 40 is disposed for bearing engagement with bearing plates 98 adjacent to slot 96 of header 90; and operating section 47 of CPA 40 is disposed in recess 97 of header 90. In this latched position, the latch 30 cannot be deflected because the operator cannot displace CPA 40, as bearing surface 48 and bearing plate 98 of header 90 will prevent any downward deflection of latch 30. Flanges 42 of CPA 40 are still slidably disposed in grooves 32 so that any upward movement of CPA 40 will necessarily cause rail 31 to abut header 90 adjacent to recess 97. Thus the header 90 and housing 20 are latched together with CPA 40 preventing any inadvertent deflection of the latch 30. Moreover, it is important to note that CPA 40 cannot be advanced from the prelatch position until the header 90 and housing 20 have been fully mated together. Furthermore, if the CPA 40 is disposed between the latch and prelatch positions prior to mating of housing 20 with header housing 90, a portion of header 90 adjacent recess 97 will engage and push CPA toward the prelatch position while the mating of housings 20,90 takes place.

To remove the header 90 from housing 20, the operator will retract CPA 40 by pressing on operating section 47 to force CPA 40 away from the mating face of housing 20. As this occurs, retraction taper 44*b* of beam 44 will be pressed into engagement with retraction taper 94*b* of deflection member 94 so that beam 44 will be deflected upwardly. When beam 44 has been so deflected, the end of beam 44 will be deflected away from stop projections 33 of latch arm 30 thereby clearing the stop projections 33 so that the CPA 40 can be fully retracted.

Thus, while a preferred embodiment of the invention has been disclosed, it is to be understood that the invention is not strictly limited to such embodiment but may be otherwise variously embodied and practiced within the scope of the appended claims. For example, it is contemplated that the connector assembly 10 can be adapted for use with crimped terminals inserted into the inner housing 50. Additionally, the slits 67 can be widened to the point of forming slots in the seal prior to complete assembly. Moreover, the rows of wire receiving apertures 63 can be staggered so that slits 67 can extend away from the apertures in substantially the same direction, for example, where the seal 60 comprises one or more rows of apertures 61. Furthermore, although the CPA 40 has been shown with flanges 42 for slidable movement in grooves 32 of latch arm 30, it is contemplated that the latch arm 30, conversely, can be adapted to include projections or flanges which would be slidable in grooves or recesses formed on the CPA 40.

Accordingly, what is claimed is:

1. An electrical connector assembly comprising a housing member with recesses for receiving respective electrical contacts therein, the electrical contacts having insulation displacement termination sections, and a seal disposed on said connector housing member having conductor receiving apertures therethrough for receiving conductors therethrough, the seal having an equal number of slits as conductor receiving apertures, each slit corresponding to an individual conductor receiving aperture and extending from the corresponding conductor receiving aperture to an outer surface of the seal, the conductor receiving apertures and the slits being in communication with the recesses, whereby as the conductors are inserted into the recesses and terminated to the insulation displacement termination sections, the conductors are also inserted through the slits into the conductor receiving apertures substantially simultaneously to provide a seal around the conductor.

2. The assembly of claim 1, wherein said seal slit passes through undulated surfaces of said seal.

3. The assembly of claim 1, wherein the housing member has an inner housing which is to be received within an outer housing, the recesses being disposed within the inner housing to receive the electrical contacts therein.

4. The assembly of claim 1, wherein the seal is mounted in said assembly between a retainer member and said housing member.

5. The assembly of claim 4, wherein said retainer includes respective recesses for receiving protuberances formed on said seal for constricting the seal adjacent respective conductors.

6. The assembly of claim 4, wherein said seal is mounted to said assembly by at least one elongated member which passes through an elongated member receiving aperture of said seal.

7. The assembly of claim 4, wherein said retainer member includes at least one conductor receiving slot in alignment with said seal slit.

8. The assembly of claim 4, wherein said retainer member includes latching structure for latching said retainer to said housing member.

* * * * *